United States Patent [19]

Prendergast et al.

[11] Patent Number: 4,779,745

[45] Date of Patent: Oct. 25, 1988

[54] DISPENSER FOR DISPLAYING AND DISPENSING MERCHANDISE

[75] Inventors: William Prendergast, Park Ridge; Rickey Martins, Lyndhurst, both of N.J.

[73] Assignee: Trans-World Manufacturing Corp., East Rutherford, N.J.

[21] Appl. No.: 98,706

[22] Filed: Sep. 18, 1987

Related U.S. Application Data

[63] Continuation of Ser. No. 779,244, Sep. 23, 1985, abandoned.

[51] Int. Cl.[4] ..... A47F 7/00

[52] U.S. Cl. ..... 211/59.2; 312/42; 312/45

[58] Field of Search ..... 211/59.2, 59.4, 42, 211/45, 49.1; 312/42–45; 229/17 B; 206/95.16; 221/92

[56] References Cited

U.S. PATENT DOCUMENTS

| | | | |
|---|---|---|---|
| 653,086 | 7/1900 | Houts | 312/42 X |
| 782,430 | 5/1904 | Tonue . | |
| 1,007,547 | 10/1911 | Durrum . | |
| 1,125,174 | 1/1915 | Rextrew | 312/42 X |
| 1,341,893 | 6/1920 | Fitzgerald | 312/45 X |
| 1,412,547 | 4/1922 | Weymuth | 312/42 X |
| 1,613,529 | 1/1927 | Payne . | |
| 1,668,171 | 5/1928 | Pratt | 312/42 |
| 1,682,838 | 9/1929 | Feigelman . | |
| 1,972,406 | 9/1934 | Marsh . | |
| 2,027,645 | 1/1936 | Marx . | |
| 2,342,452 | 2/1944 | Casteen . | |
| 2,519,949 | 8/1950 | Winton | 312/42 X |
| 2,730,231 | 6/1956 | Ryan | 312/42 X |
| 2,785,843 | 3/1957 | Shaw | 312/42 X |
| 2,805,111 | 9/1957 | Jarnot | 312/42 |
| 3,002,651 | 10/1961 | Gauld | 312/45 X |
| 3,204,816 | 9/1965 | Zorner . | |
| 3,207,564 | 9/1965 | Patrick et al. . | |
| 3,284,147 | 11/1966 | Schroder et al. . | |
| 3,352,614 | 11/1967 | Andersen | 312/42 |
| 3,433,545 | 3/1969 | Rainey . | |
| 3,568,883 | 3/1971 | Reynolds . | |
| 3,568,911 | 3/1971 | Bebout . | |
| 3,776,419 | 12/1973 | Zinkgraf et al. . | |
| 3,858,757 | 1/1975 | Langdon, Jr. . | |
| 3,957,174 | 5/1976 | Palamara . | |
| 4,148,413 | 4/1979 | Immordino . | |
| 4,396,237 | 8/1983 | Henry | 211/59.2 X |
| 4,401,255 | 8/1983 | Conroy et al. . | |
| 4,530,548 | 7/1985 | Spamer | 211/59.2 X |

FOREIGN PATENT DOCUMENTS

| | | | |
|---|---|---|---|
| 873185 | 6/1971 | Canada . | |
| 501602 | 3/1939 | United Kingdom | 312/45 |

*Primary Examiner*—Reinaldo P. Machado
*Assistant Examiner*—Sarah A. Lechok Eley
*Attorney, Agent, or Firm*—Ostrolenk, Faber, Gerb & Soffen

[57] ABSTRACT

A dispenser for displaying and dispensing items of merchandise such as packages of cigarettes includes a foldable inner molding which, when in the folded position, holds a replaceable display sleeve. The inner molding has a center panel with a center divider for dividing the dispenser into left and right sides, and left and right panels are attached to the center panel along left and right fold lines. Each of the left and right panels has a side divider for dividing the respective side of the dispenser into forward and rearward compartments, each of which holds a column of the cigarette packages. Integral with each of the left and right panels are forward and rearward column supports for holding the forward and rearward columns of packages, respectively. The inner molding may be constructed of a sturdy and washable material such as injection molded plastic. Around it fits a display sleeve which helps to hold the inner molding in the folded position, but which may be constructed of a much less expensive material such as paperboard. A display is provided on the sleeve, and the sleeve may be readily removed and replaced to provide a different display.

18 Claims, 3 Drawing Sheets

FIG. 6.
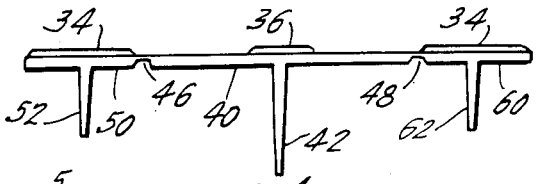
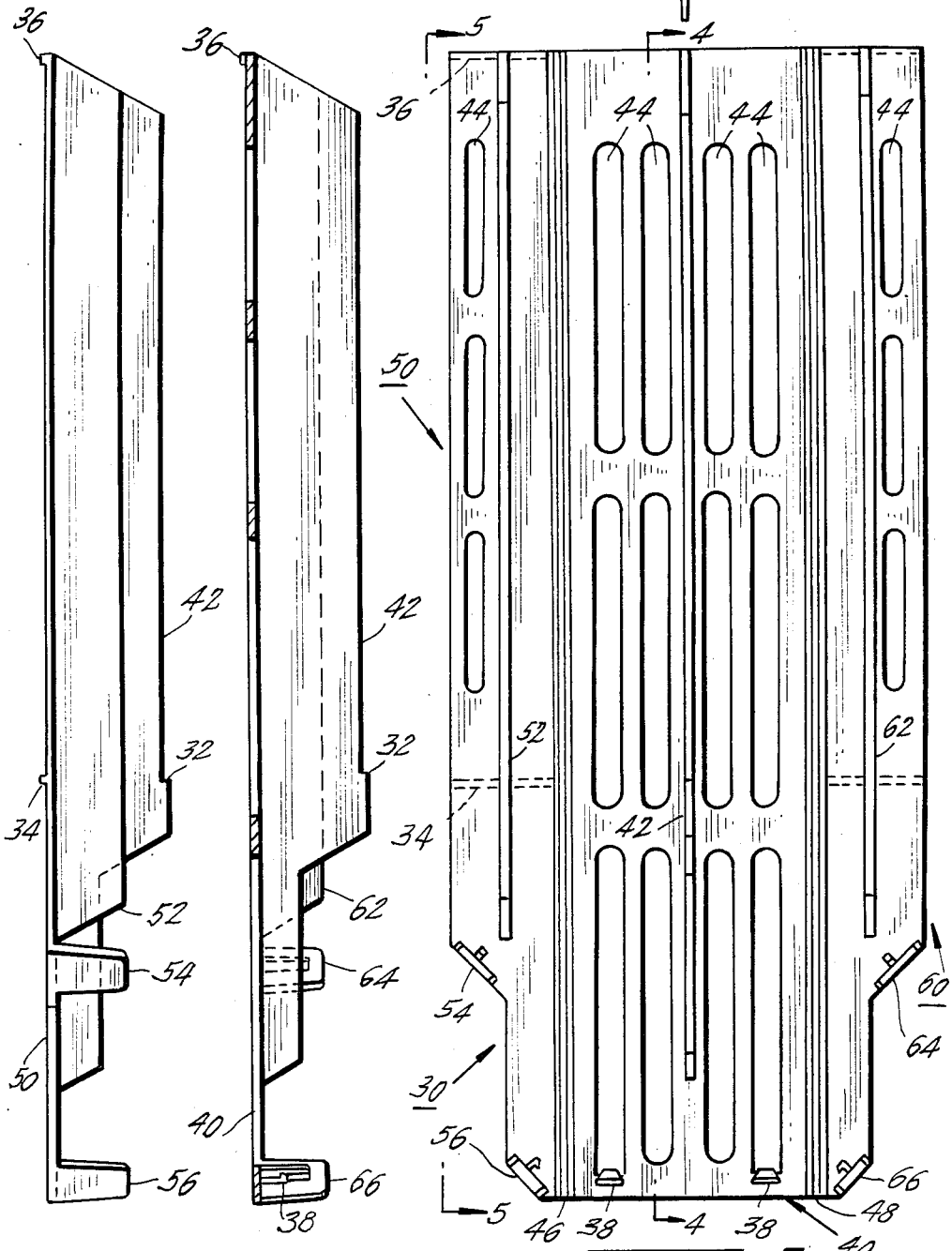
FIG. 5. FIG. 4. FIG. 3.

FIG. 10.
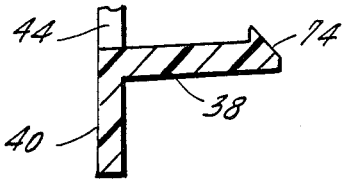
FIG. 11.
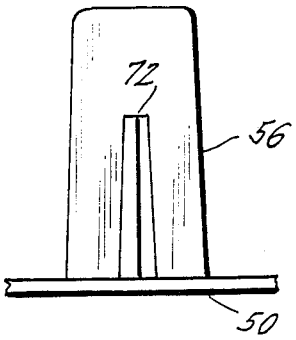
FIG. 12.
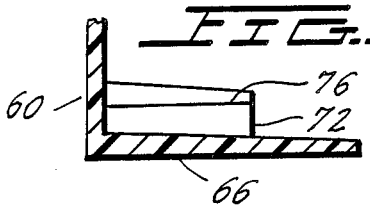
FIG. 7.
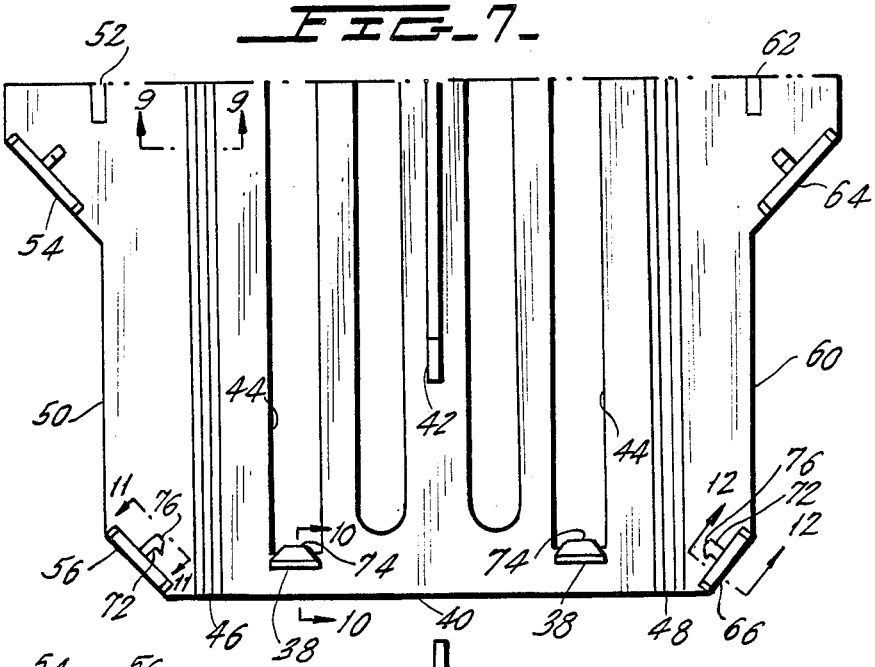
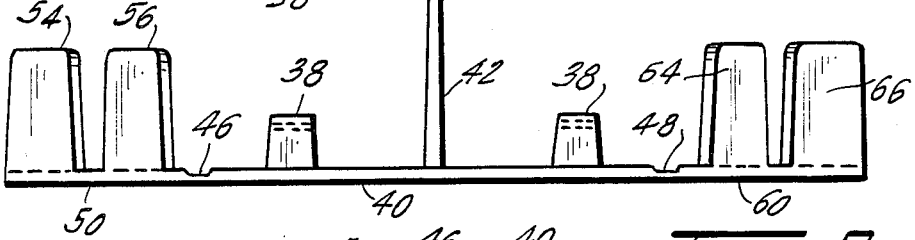
FIG. 8.
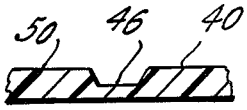
FIG. 9.

DISPENSER FOR DISPLAYING AND DISPENSING MERCHANDISE

This is a continuation of application Ser. No. 779,244 filed on Sept. 23, 1985, now abandoned.

BACKGROUND OF THE INVENTION

The present invention relates to a dispenser which displays merchandise for sale and also holds a quantity of the displayed merchandise to be dispensed. More specifically, the present invention relates to a dispenser which may be used to display several packages of merchandise such as cigarette packages, the removal of one of the displayed packages resulting in its replacement by another package previously stored within the dispenser.

A variety of dispensers and similar structures for displaying and dispensing items of merchandise such as packages of cigarettes are known. Some such dispensers have structures which require that they be manufactured and assembled in advance, so that they cannot be shipped as an assembly to be put together by the ultimate retail merchant or by an intermediate wholesaler. An example of such a dispenser is the dispenser disclosed in U.S. Pat. No. 4,148,413, which is thermally folded into its desired configuration. Another dispenser with a relatively complex construction from modular parts is disclosed in U.S. Pat. No. 3,858,757. U.S. Pat. No. 3,957,174 disclosed injection molded one- and two-piece constructions which may be mass-produced in advance of use.

Other dispensers are made of a paperboard or other similar material and may be provided for assembly at the point of use in the form of a foldable blank. Although readily shipped and assembled at the point of use, these dispensers are susceptible to damage because they are made from paperboard. For example, the support structure may become weakened through lengthy use and may, as a result, break, resulting in the accidental release of the merchandise. Furthermore, the repeated withdrawal of packages from the dispenser will inevitably cause wear on the paper, making it less attractive. The repeated handling of the dispenser by salespeople will cause it to become dirty and less attractive, but because of the paperboard construction, the dispenser cannot be easily cleaned and returned to its original condition. Therefore, a dispenser of this type is typically filled only once, and is discarded when the initial merchandise is exhausted. As a result, the merchandise may not be displayed again until a new dispenser is obtained, or the discarded dispenser may be replaced by a dispenser containing competing merchandise, in which case a new dispenser with the original merchandise may not be placed on display again in the same space. A valuable location may thus be lost to a competing product.

It would be advantageous to have a more durable dispenser for displaying and dispensing items of merchandise stored in columns which could be easily assembled at the point of use and which could be returned to its original condition after a period of use without being removed and replaced. Furthermore, it would be advantageous to have such a dispenser on which a display on the outside of the dispenser could be replaced by a new display when desired.

SUMMARY OF THE INVENTION

The present invention provides a dispenser for displaying and dispensing items of merchandise from a column which may be easily assembled at the point of use and which has a detachable display which helps to hold the dispenser in its assembled position and which may be replaced to change the display.

An assembly according to the present invention includes a frame member which defines at least one compartment in which a column of items are stored, with the lowest item in the column being positioned for dispensing. A detachable display member fits on the frame member and may be detached from the frame member and replaced for changing a display on the detachable member.

The frame member, according to the invention, may be an inner molding constructed from a relatively sturdy, washable material such as plastic, while the detachable member may be constructed from a relatively lightweight, inexpensive material such as paperboard on which the display may be formed by a process such as lithography. The inner molding may be foldable, with three foldable panels separated by two fold lines defined therein, and with each column support being integral with one of the foldable panels. The assembly of the dispenser thus includes folding the inner molding into the folded position. The inner molding may be held in the folded position by hooks on the panels and by the detachable member.

According to one embodiment of the invention, the two fold lines are generally parallel, with a center panel between them and left and right panels joining the center panel at the fold lines. The center panel may have a center divider on it for dividing the dispenser into left and right sides. Each of the side panels may similarly have at least one side divider on it for dividing the left and right sides of the dispenser into forward and rearward compartments, after the sides have been folded 90 degrees, each compartment holding a single column of the items. Each of the left and right panels may also have supports thereon for supporting the lowest item in each of the columns, and these supports may be integral with the left and right panels.

The detachable member may be a sleeve which fits around the inner molding in the folded position, holding the stored items in place, preventing the inner molding from moving out of the folded position and covering the stored items with a display relating to those items. In order to replace this display, all that is necessary is to replace the detachable member, but the dispenser may not be used without the detachable member because the detachable member helps to hold items in the dispenser.

These and other objects, features and advantages of the invention will be apparent from the following description of preferred embodiments considered together with the accompanying drawings.

BRIEF DESCRIPTION OF THE DRAWINGS

FIG. 3 is a front plan view of the inner molding of FIG. 2 in its unfolded position.

FIG. 4 is a longitudinal cross-sectional view of the inner molding of FIG. 3 taken along the line 4—4.

FIG. 5 is a longitudinal side view of the inner molding of FIG. 3 taken along the line 5—5.

FIG. 6 is a top view of the inner molding of FIG. 3.

FIG. 7 is a detail of the lower part of the inner molding of FIG. 3.

FIG. 8 is a bottom view of the inner molding of FIG. 7.

FIG. 9 is a lateral cross-sectional detail of the inner molding of FIG. 7, taken along the line 9—9.

FIG. 10 is a cross-sectional detail of a hook of FIG. 7, taken along the line 10—10.

FIG. 11 is an oblique cross-sectional view of the inner molding of FIG. 7, taken along the line 11—11.

FIG. 12 is an oblique cross-sectional detail of the inner molding of FIG. 7, taken along the line 12—12.

DETAILED DESCRIPTION OF THE PREFERRED EMBODIMENTS

Figure 1:
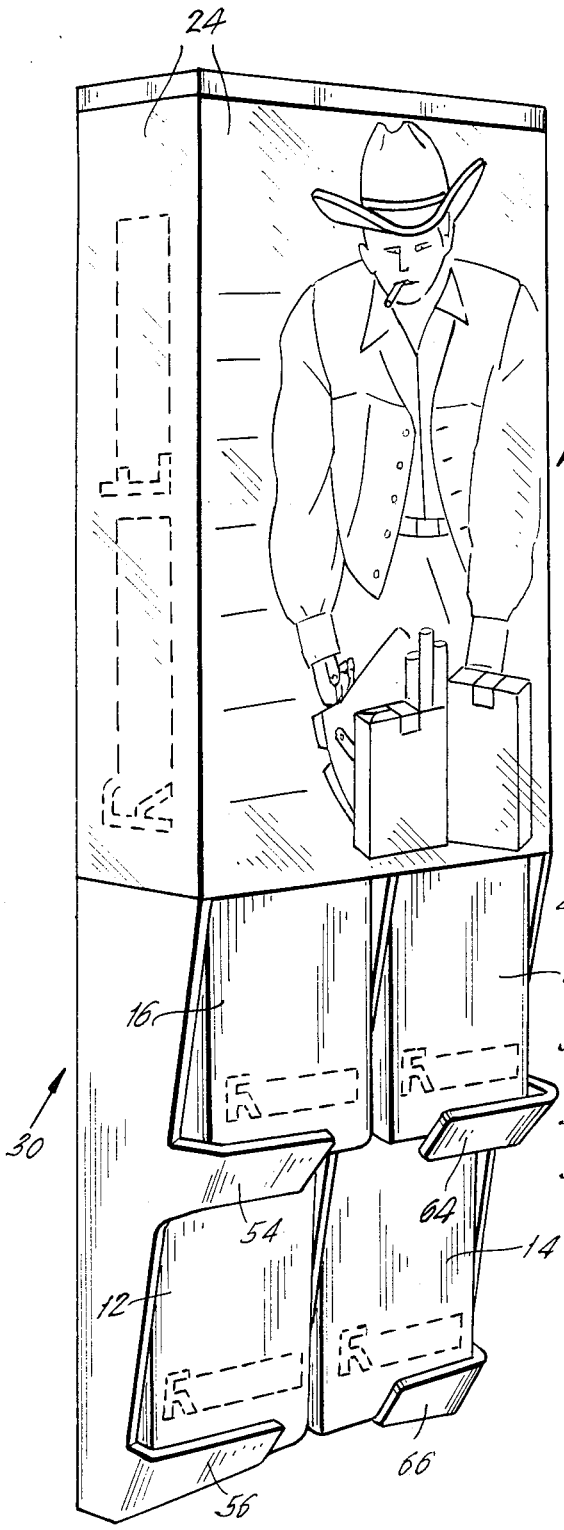
FIG. 1 is a perspective side view showing an assembled dispenser according to the present invention.

FIG. 1 shows dispenser 10 according to the present invention as it appears when assembled. Dispenser 10 includes sleeve 20, which serves as a detachable display member, and inner molding 30, which serves as a frame member. As shown in FIG. 1, dispenser 10 may hold four columns of items of merchandise such as packages of cigarettes. The lowest item of each column, such as items 12, 14, 16 and 18, is held in a position from which it is visible and may be dispensed. As each of the lowest items 12, 14, 16 or 18, is removed for sale, the items above it in the respective column drop down due to gravity so that the lowest of the remaining items is again in a position from which it may be displayed and dispensed.

Figure 2:
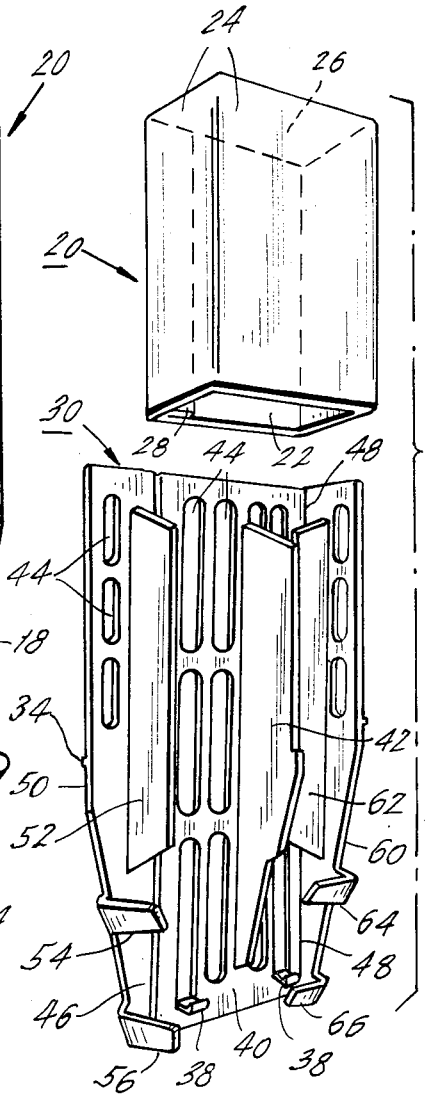
FIG. 2 is an exploded side view of an inner molding and sleeve which form the dispenser of FIG. 1.

FIG. 2 shows sleeve 20 and inner molding 30, shown in a partially folded position. As shown in FIG. 2, inner molding 30 has a center panel 40, at the left side of which is a left panel 50 and at the right side of which is a right panel 60. Center panel 40 has a center divider 42 on it which divides the dispenser into left and right sides. In the surface of panels 40, 50 and 60, holes 44 are defined to reduce the weight of inner molding 30. The left panel 50 joins center panel 40 at left fold line 46, while the right panel 60 joins the center panel 40 at right fold line 48. As shownin FIG. 2, right panel 60 is in the folded position, while left panel 50 is in the unfolded position, the position in which the inner molding 30 would ordinarily be shipped and stored.

Each of the left and right panels 50 and 60 has a respective side divider 52 and 62, which serves to divide the respective side of the dispenser into a forward and a rearward compartment, each compartment holding a column of packages of cigarettes. Forward column supports 54 and 64 support the lowest pacakges 16 and 18 of each of the respective forward columns, while rearward column supports 56 and 66 support the lowest cigarette packages 12 and 14 of each of the respective rearward columns. Therefore, inner molding 30, in the folded position, defines all of the compartments in which the columns of cigarette packages are stored. The forward columns are open, however, at the front side of inner molding 30, so that means should be provided to hold items of merchandise in those columns. As discussed below, means may also be provided for holding inner molding 30 in the folded position.

The structure of inner molding 30 may take any appropriate form. For example, inner molding 30 may be a foldable plastic unit injection molded of a sturdy and washable plastic material, such as impact styrene having a general thickness of roughly 0.08 of an inch. The supports 54, 56, 64 and 66 may be integral with the respective left and right panels 50 and 60 so that they can adequately support the weight of the packages of cigarettes in the respective columns. Similarly, the dividers 42, 52 and 62 may each be integral with the respective one of panels 40, 50 and 60. Although it is presently preferred to form inner molding 30 with panels 40, 50 and 60 in a plane and with dividers 42, 52, 62 and supports 54, 56, 64, 66 perpendicular thereto so that no undercuts are needed, it would also be possible to mold inner molding 30 in the folded position. Forming inner molding 30 with panels 40, 50 and 60 in a plane is simpler, however.

FIG. 2 also shows sleeve 20 which fits over inner molding 30 when inner molding 30 is in the folded position, helping to hold it in that position. Central opening 22 of sleeve 20 is sized so that it fits over inner molding 30 in the folded position snugly, but may be removed and replaced without difficulty. Sleeve 20, when on inner molding 30, holds the forward columns of cigarettes in place and also helps to hold inner molding 30 in the folded position. Because of its resiliency, inner molding 30 will tend to return to the unfolded position, and the resulting outward tension also helps to hold sleeve 20 in position.

The entire outer surface of sleeve 20 may serve as display surface 24, although the front and side panels would be of particular importance. Display surface 24, as shown in FIG. 1, covers most of the stored packages of cigarettes, and may be used to provide additional advertising or promotional information to encourage purchase of the cigarettes in the dispenser. Because of the ease with which sleeve 20 may be removed and replaced, any change in the advertising or promotion of the cigarettes may be reflected on the display surface 24. A different type of cigarette, a different brand, or different promotional graphics could be displayed simply by replacing sleeve 20.

Sleeve 20 has an open top 26 for refilling dispenser 10 as the supply of package of cigarettes is depleted. FIG. 2 shows flap 28, indicating that sleeve 20 may be assembled from paperboard such as tag stock and folded and glued. As is apparent from FIG. 2, sleeve 20 could be folded into a flat position for storage and distribution, and could then be unfolded into the open position for assembly of dispenser 10. The use of paperboard for the manufacture of sleeve 20 is especially desirable because it facilitates the printing of display surface 24 by processes such as lithography, so that sleeve 20 is relatively inexpensive to manufacture and print.

FIG. 3 shows inner molding 30 in its unfolded position, in plan view. As described above, center panel 40 is flanked on either side by left panel 50 and right panel 60, which are joined to center panel 40 at left fold line 46 and right fold line 48, respectively. Dividers 42, 52, and 62 are perpendicular to the plane of panels 40, 50, 60, as are supports 54, 56, 64, 66. Holes 44 are defined in inner molding 30 for lightness and for more efficient use of materials.

FIGS. 4 and 5 show more clearly the relationship between dividers 42, 52 and 62, and also show some features of supports 54, 56, 64, 66. As can be seen in these figures, center divider 42 is preferably slightly greater in height than side dividers 52 and 62. Also, center divider 52 has lip 32 formed therein to prevent sleeve 20 from sliding downward from its preferred position. Similarly, left and right panels 50 and 60 each have a lower nub 34 for the same purpose. At the center of center panel 40 is upper nub 36, which similarly prevents the movement of sleeve 20 upward in relation to inner molding 30. FIG. 6, a top view of inner molding 30 similarly shows lower nubs 34 and upper nub 36 in relation to dividers 42, 52, and 62.

As shown in FIGS. 4 and 5, supports 54, 56, 64, 66 have substantially the same height as side dividers 52 and 62. As can be seen from FIGS. 3–5, each of these supports extends substantially perpendicular to the plane of panels 40, 50, 60, with a tab portion extending part of the height of each support for structural strength. As shown in FIG. 7, the tabs 72 of the lower supports 54, 64 each have a hook 76 defined on them, for engaging the corresponding hooks 38 on center panel 40, as discussed in greater detail below. FIG. 8 shows hooks 38 in profile in relation to supports 54, 56, 64, 66.

FIG. 9 shows left fold line 46 in cross-section, with left panel 50 at the left and center panel 40 at the right. As can be seen, left fold line 46 is formed by providing a groove in inner molding 30 between left panel 50 and center panel 40 and right fold line 48 is formed in the same way between center panel 40 and right panel 60. If inner molding 30 has a general thickness of 0.08 of an inch, the groove of each fold line 46, 48 may reduce the thickness to approximately 0.02 of an inch at the center of each fold line 46, 48. For a material such as impact styrene, this will provide a fold line which can be folded relatively easily, but which will have a tendency to return to its unfolded position.

As noted above, sleeve 20 helps to hold inner molding 30 in its folded position. In addition, FIGS. 7 and 10–11, show how the present invention provides snap lock means for holding the lower part of inner molding 30 in the folded position. The snap lock means includes hooks 38 on the center panel 40 and tabs 72 on side panels 50 and 60 abutting lower supports 56 and 66. As shown in cross-section in FIG. 10, each hook 38, at its end away from center panel 40, has a head 74 with an upwardly extending point. The main body of each hook 38 may be slightly inclined toward the top of inner molding 30 as it extends away from center panel 40, to improve its resilience in the upward direction. This inclination and head 74 do not result in an undercut because the adjacent hole 44 is extended to the base of hook 38. Tabs 72 on lower supports 56, 66 similarly each have a head 76, as shown in FIGS. 11 and 12, which extends slightly downward from the main body of each tab 72, and which is positioned to engage the head of the corresponding hook 38 to snap lock when the side panels 50 and 60 are folded into the folded position. As shown in FIG. 10, each tab 72 extends to a sufficient height so that it will engage the corresponding hook 38. In addition, each tab is slightly tapered as it extends to its top, and, as shown in the view of FIG. 11, the lip of the head 76 on each tab is similarly tapered so that the heads 76 can more easily be snapped onto the heads 74 of hooks 38, but will remain resilient to maintain the snap locking engagement.

Dispenser 10, when assembled, may be hung on a wall by appropriate means such as a foam stick pad (not shown) attached to inner molding 30 or a key hole (not shown) defined in center panel 40. Sleeve 20 may have an opening defined therein to expose the means for hanging dispenser 10. Dispenser 10 alternatively may be rested on a horizontal surface and may lean against a vertical surface such as a wall.

Dispenser 10 could also be modified in other ways within the scope of the invention. For example, more than two columns could be provided on each side of the center divider 42 by providing more than one side divider on each of the left and right panels 50 and 60 and by providing more than two of the columns supports on each of the left and right panels 50 and 60. The dimensions of inner molding 30 could be modified for a different sized package of cigarettes or for a different number of packages in each column. Instead of being a sleeve, the display member could be a panel or a relatively rigid C-shaped member which would simply snap onto the front side of the inner molding 30, helpint to hold it in the folded position and providing the display. Another alternative would be to extend supports 54, 56, 64, 66 to provide a snap lock with each other.

In practice, inner molding 30 will be produced in a relatively large quantity by injection molding, with any surplus of units being stored for later distribution. Sleeve 20, on the other hand, will be produced according to current needs. When sleeve 20 on a particular unit is to be replaced, inner molding 30 could, if necessary, be washed or otherwise cleaned. Then a replacement sleeve 20 will be put on inner molding 30. In this manner, dispenser 10 is likely to keep a relatively permanent display position, rather than being discarded when emptied, so that sales of the dispensed produce will be enhanced.

Although the present invention has been described in connection with preferred embodiments, many variations and modifications will now be apparent to those skilled in the art. It is preferred, therefore, that the present invention be limited not by the specific disclosure herein, but only by the appended claims.

What is claimed is:

1. An assembly for displaying and dispensing items of merchandise comprising:

a frame member for defining at least one storage compartment, said at lest one storage compartment being for storing items of merchandise in a respective column, the frame member having a respective support for supporting each respective column by supporting a lowest one of the items in that column in a position in which it is displayed and from which it may be dispensed;

said frame member comprising a center panel and two side panels, said side panels extending generally perpedicularly from said center panel, but said frame member having resiliency such that said side panels tend to spread apart to define angles greater than 90° with said center panel; and a replaceable cover sleeve for fitting on the frame member, said cover sleeve comprising a display surface, the cover sleeve being detachable from the frame member and replaceable to provide a different display surface with a different display thereon;

wherein a first part at an upper portion of the frame member is shaped for fitting into the cover sleeve;

the cover sleeve thereby helping to hold the side panels, at said first part of the frame member, substantially perpendicular to the center panel, when the first part is fitted into the cover sleeve; and the pressure exerted by the first part on the cover sleeve helping to hold the cover sleeve in position on the first part of the frame member;

said frame member further comprising locking means at a lower portion of said frame member for locking said side panels, at said lower portion of the frame member, substantially perpendicular to said center panel; and said frame member having means thereon for engaging the sleeve, to hold the sleeve in position fittted onto the first part of the frame member, and prevent said sleeve from moving onto said lower portion of said frame member.

2. The assembly of claim 1 in which the frame member is foldable from an unfolded position into a folded position in which it defines the at least one storage compartment.

3. The assembly of claim 2 in which the frame member has at least one fold line therein and has adjacent panels on each side of the fold line, the frame member being foldable along the fold line into the folded position, each of the adjacent panels having a hook member thereon, the hook members being said locking means and engaging when the frame member is folded into the folded position for holding the frame member in the folded position.

4. The assembly of claim 2 in which the frame member in the unfolded position has an open side, the replaceable cover sleeve fitting over the open side for holding the items of merchandise in the storage compartment.

5. The assembly of claim 2 in which there are a plurality of the storage compartments, the frame member having at least one fold line defined therein and having adjacent panels on each side of the fold line, the frame member being foldable along the fold line to define the storage compartments, at least one of the panels having a divider thereon for dividing the storage compartment.

6. An assembly as in claim 5, in which one of the panels is a center panel and another of the panels is a side panel, the side panel having at least one divider theron for dividing the storage compartments when in the folded position with a rearward storage compartment defined between the divider and the center panel and a forward storage compartment defined opposite the divider from the rearward compartment, the respective support for the rearward compartment being below the respective support for the forward compartment so that the lowest item in the rearward compartment is displayed below the lowest item in the forward compartment.

7. The assembly of claim 1 in which the frame member is a single injection molded plastic piece, the supports being integral parts of the frame member.

8. A frame member for a dispenser comprising:

a generally planar member having first and second generally parallel fold lines defined therien with a center panel between the fold lines, and left and right panels joining the center panel at the first and second fold lines, respectively; the planar member being foldable at the first and second fold lines into a folded position in which the panels enclose at least one storage compartment, said at least one storage compartment being for storing items of merchandise in a respective column; and for each respective column, a respective support on the planar member for supporting that column by supporting a lowest one of the items in that column in a position from which the lowest one may be dispensed;

the planar member further being resilient so as to tend to return to the unfolded position from the folded position, said right and left panels extending generally perpendicularly from said center panel, but said planar member having resiliency such that said left and right panels tend to spread apart to define angles greater than 90° with said center panel; and further comprising retaining means for retaining the planar member in the folded position, the retaining means comprising a cover sleeve, wherein a first part, defined at an upper part of the planar member in the folded position, is shaped for fitting into the cover sleeve, to retain the planar member in the folded position; and the pressure exerted by the first part on the cover sleeve helps to hold the cover sleeve in position on the first part of the planar member;

said planar member further comprising locking means at a lower portion of said planar member, away from said first part, for locking said lower portion in said folded position;

said planar member further comprising means thereon for engaging the cover sleeve to hold said sleeve in position fitted on said first part of the planar member, and prevent said cover sleeve from moving onto said lower portion.

9. The frame member of claim 8 in which the planar member is resilient and tends to return to an unfolded position from the folded position, the holding means comprising hooks which are held together by the tendency of the planar member to return to the unfolded position.

10. A frame member as in claim 8, wherein said locking means comprises:

right and left hooks on said lower portion on the right and left panels, respectively, and first and second hooks on the central panel, the first and second hooks being for engaging the right and left hooks, respectively, for holding the planar member in the folded position.

11. The frame member of claim 8, further comprising a center divider on and generally perpendicular to the center panel for dividing the storage compartments.

12. A frame member as in claim 11, further comprising:

right and left side dividers on and generally perpendicular to the right and left panels, respectively, for dividing the storage compartments.

13. The assembly of claim 1 in which the means for engaging the sleeve includes at least one lower projection adjacent said lower end of said first part for engaging a lower end of the sleeve, and at least one upper projection adjacent said upper end of said first part, the upper projection engaging an upper end of the sleeve when the lower projection engages the lower end of the sleeve.

14. The assembly of claim 13 in which the sleeve comprises material which is easily releasable from said upper and lower projections for being detached from the frame member.

15. The assembly of claim 1 in which there are a plurality of storage compartments, the frame member having at least one fold line defined therein and having adjacent panels on each side of the fold line, the frame member being foldable along the fold line to define the storage compartments, in which one of the panels is a center panel and the other of the panels is a side panel, the center panel having at least one divider thereon for dividing the storage compartments, said means for engaging the sleeve being adjacent and upper end and a lower end of said first part, for engaging the sleeve to maintain the sleeve in position when the first part of the frame member is fitted into the sleeve, and said means for engaging the sleeve includes at least one lower projection adjacent said lower end of said first mounting part for engaging a lower end of the sleeve, and at least one upper projection adjacent said upper end of said first part, the upper projection engaging an upper end of the sleeve when the lower projection engages the lower end of the sleeve; and in which said at least one lower projection is on an outer surface of one of said center divider and said side panel.

16. The assembly of claim 15 in which one lower projection is on an outer surface of said center divider and one lower projection is on an outer surface of said side panel.

17. The assembly of claim 15, wherein the at least one upper projection is on an outer surface of said center panel.

18. The frame member of claim 8 in which the means for engaging the sleeve on the planar member includes at least one lower projection adjacent said lower end of said first part for engaging a lower end of the sleeve, and at least one upper projection adjacent said upper end of said first part, the upper projection engaging an upper end of the sleeve when the lower projection engages the lower end of the sleeve.

* * * * *